US007284540B2

(12) United States Patent
Attwood et al.

(10) Patent No.: US 7,284,540 B2
(45) Date of Patent: Oct. 23, 2007

(54) FUEL PUMP MODULE ANTI-SIPHON VALVE

(75) Inventors: William Attwood, LaSalle (CA); Norihiro Hayashi, Kakamigahara (JP)

(73) Assignees: Denso International America, Inc., Southfield, MI (US); DENSO Corporation, Kariya (JP)

( * ) Notice: Subject to any disclaimer, the term of this patent is extended or adjusted under 35 U.S.C. 154(b) by 0 days.

(21) Appl. No.: 11/377,493

(22) Filed: Mar. 16, 2006

(65) Prior Publication Data

US 2007/0215121 A1 Sep. 20, 2007

(51) Int. Cl.
*F02M 37/04* (2006.01)

(52) U.S. Cl. ..... 123/509; 123/516; 137/565.22

(58) Field of Classification Search ..... 123/509, 123/514, 456, 516, 510; 137/571, 574, 565.22, 137/565.3

See application file for complete search history.

(56) References Cited

U.S. PATENT DOCUMENTS 4,724,868 A * 2/1988 Kasugai et al. ..... 137/516.29
4,974,570 A * 12/1990 Szwargulski et al. ..... 123/509
5,070,849 A * 12/1991 Rich et al. ..... 123/509
5,170,764 A * 12/1992 Tuckey ..... 123/509
5,979,485 A * 11/1999 Tuckey et al. ..... 137/143
6,273,131 B1 * 8/2001 Kleppner ..... 137/565.22
6,505,644 B2 * 1/2003 Coha et al. ..... 137/565.22
6,805,106 B2 * 10/2004 Kumagai et al. ..... 123/514
6,871,640 B2 * 3/2005 Atwood et al. ..... 123/509
6,907,899 B2 * 6/2005 Yu et al. ..... 137/565.22

* cited by examiner

*Primary Examiner*—Carl S. Miller
(74) *Attorney, Agent, or Firm*—Harness, Dickey & Pierce, PLC

(57) ABSTRACT

A fuel pump system for a fuel tank having a first and a second section has a fuel pump and a jet pump disposed in the first section. The jet pump draws fuel from the second section of the fuel tank through a transfer line and delivers it to the first section of the fuel tank. A check valve is located in the second section of the fuel tank to prohibit flow from the first section to the second section but to allow flow from the second section to the first. In this manner, the fluid is retained within transfer line so that a siphoning action can occur between the second section and the first section of the fuel tank.

16 Claims, 4 Drawing Sheets

FUEL PUMP MODULE ANTI-SIPHON VALVE

FIELD

The present invention relates to a fuel pump system which transfers fuel between two tanks or between two sections of a single tank. More particularly, the present invention relates to an anti-siphon valve positioned in the tank or portion of the tank opposite to the fuel pump.

BACKGROUND

The statements in this section merely provide background information related to the present disclosure and may not constitute prior art.

The designs for some vehicles limit the space available for a single section fuel tank with enough fuel capacity for the vehicle. For these vehicles, either multiple fuel tanks or multiple section fuel tanks such as saddle tanks have been developed. Typical fuel delivery systems draw fuel from a single inlet and with the incorporation of a multiple section fuel tank, either multiple fuel inlets have to be developed or systems for equalizing the fuel in the separate sections of the fuel tank need to be incorporated.

While systems have been developed for multiple inlets, the independent drawing of fuel from the multiple sections leads to the problem of unequal levels of fuels in the multiple sections due to unequal drawing of the fluid from each section. Systems have also been developed for transferring fuel between various sections of the fuel tank to equalize the fuel level in each section. In one system, in a saddle type fuel tank, fuel is siphoned between a fuel tank sub side and a fuel tank main side within which is located the fuel pump module, which pumps fuel to the engine of the vehicle. The siphoning action is started and maintained by having the fuel pump module pump a portion of the fuel to the fuel tank sub side to purge gas from the siphon line which then transfers fuel to the fuel tank main side when unequal levels of fuel exist.

In other systems, a jet pump of the fuel pump module operates to draw fuel from the fuel tank sub side to the fuel tank main side. In order to maintain an uninterrupted supply of fuel to the engine, the jet pump of the fuel pump module must be submerged in fuel at all times to maintain its primed state in order to transfer fuel from the fuel tank sub side to the fuel tank main side. If the jet pump of the fuel pump module is not maintained in a primed or submerged condition, the transfer of fuel from the tank sub side to the tank main side may not be maintained and thus, uninterrupted supply of fuel to the engine may not be maintained.

During instances of quick vehicle maneuvering, sloshing of fuel from the fuel tank main side to the fuel tank sub side may occur. When this occurs, an instant imbalance of fuel levels between the fuel tank main side and the fuel tank sub side occurs. While current transfer lines between two sections of a fuel tank are designed to eventually equalize the fuel levels, they do not have the fuel transfer volume capability to equalize this sloshed fuel imbalance quickly. This may result in an excess amount of fuel in the fuel tank sub side and an insufficient amount of fuel in the fuel tank main side leading to a loss of priming for the jet transfer pump. Ultimately, this may result in losing the uninterrupted supply of fuel to the engine, even though the fuel tank sub side has sufficient fuel to be transferred to the fuel tank main side.

In situations where fuel sloshing occurs in the opposite direction or from the fuel tank sub side to the fuel tank main side, current transfer systems will equalize the fuel levels by transferring fuel from the fuel tank main side to the fuel tank sub side. This is an unnecessary transfer since the fuel that has been transferred to the fuel tank sub side from the fuel tank main side will eventually have to be retransferred back to the fuel tank main side.

SUMMARY

The present invention provides the art with a fuel transfer system that keeps the fuel in the fuel tank main side while transferring fuel from the fuel tank sub side. Regardless of the difference in levels of the two sides of the fuel tank, once fuel has been transferred to the fuel tank main side, it is kept in the fuel tank main side. The present invention incorporates an anti-siphon valve at the fuel inlet in the fuel tank sub side to prohibit fuel flow from the fuel tank main side to the fuel tank sub side through the single fuel transfer line.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
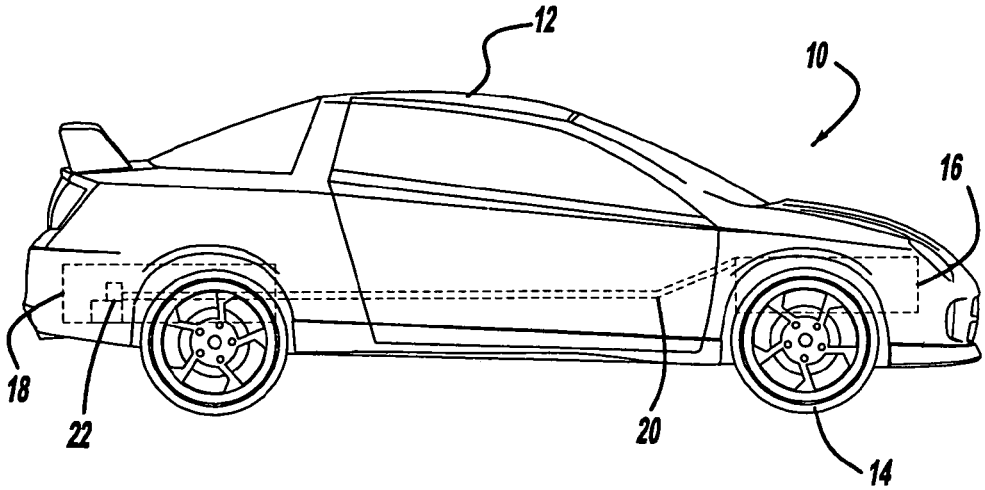
FIG. 1 is a perspective view of an automobile incorporating a saddle tank and an anti-siphon valve in accordance with the present invention.

The following description is merely exemplary in nature and is not intended to limit the present disclosure, application, or uses. It should be understood that throughout the drawings, corresponding reference numerals indicate like or corresponding parts and features.

There is illustrated in FIG. 1 a vehicle which incorporates a fuel pump module in accordance with the present invention and which is designated generally by reference numeral 10. Some vehicles, and more specifically sports cars and sport sedans, are rear wheel drive vehicles that have a propeller shaft running between an engine located in the front of the vehicle and a transmission located in the rear of the vehicle or between a transmission located in the front of the vehicle and a differential located in the rear of the vehicle. When positioning the fuel tank in the rear of the vehicle, accommodations must be made to provide room for the propeller shaft. Typically this is accomplished by utilizing a saddle type fuel tank having a first section located on one side of the propeller shaft, a second section located on an opposite side of the propeller shaft and a bridge section connecting the first and second sections. This allows for the propeller shaft to be located between the two side sections of the fuel tank and under the bridge section of the fuel tank. With this saddle type of fuel tank, fuel needs to be drawn from each side section of the fuel tank or fuel needs to be transferred from one side section to the other side section typically through the bridge section.

Figure 2:
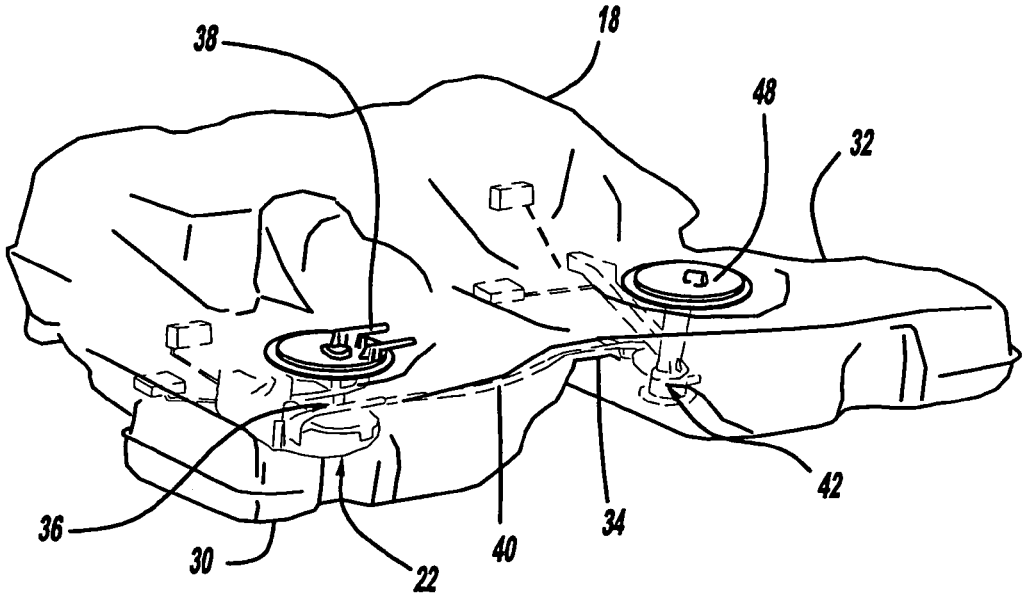
FIG. 2 is a perspective view of the saddle tank illustrated in FIG. 1 including the fuel pump module and transfer system in accordance with the present invention.

Referring to FIGS. 1 and 2, vehicle 10 includes a body 12, a set of wheels 14, an engine 16, a fuel tank 18 and a fuel line 20 extending between fuel tank 18 and engine 16 to supply fuel to engine 16 using a fuel pump module 22 disposed within fuel tank 18. Fuel tank 18 is a saddle type fuel tank which includes a fuel tank main side 30, a fuel tank sub side 32 and a bridge section 34. Fuel tank main side 30 houses a fuel pump 36 which is a part of fuel pump module 22. Fuel pump 36 pumps fuel from fuel tank main side 30 to engine 16 through an outlet 38 which is connected to fuel line 20. Fuel tank main side 30 communicates with fuel tank sub side 32 through bridge section 34 and a transfer line 40 which extends from fuel tank sub side 32 to fuel tank main side 30 though bridge section 34.

Figure 3:
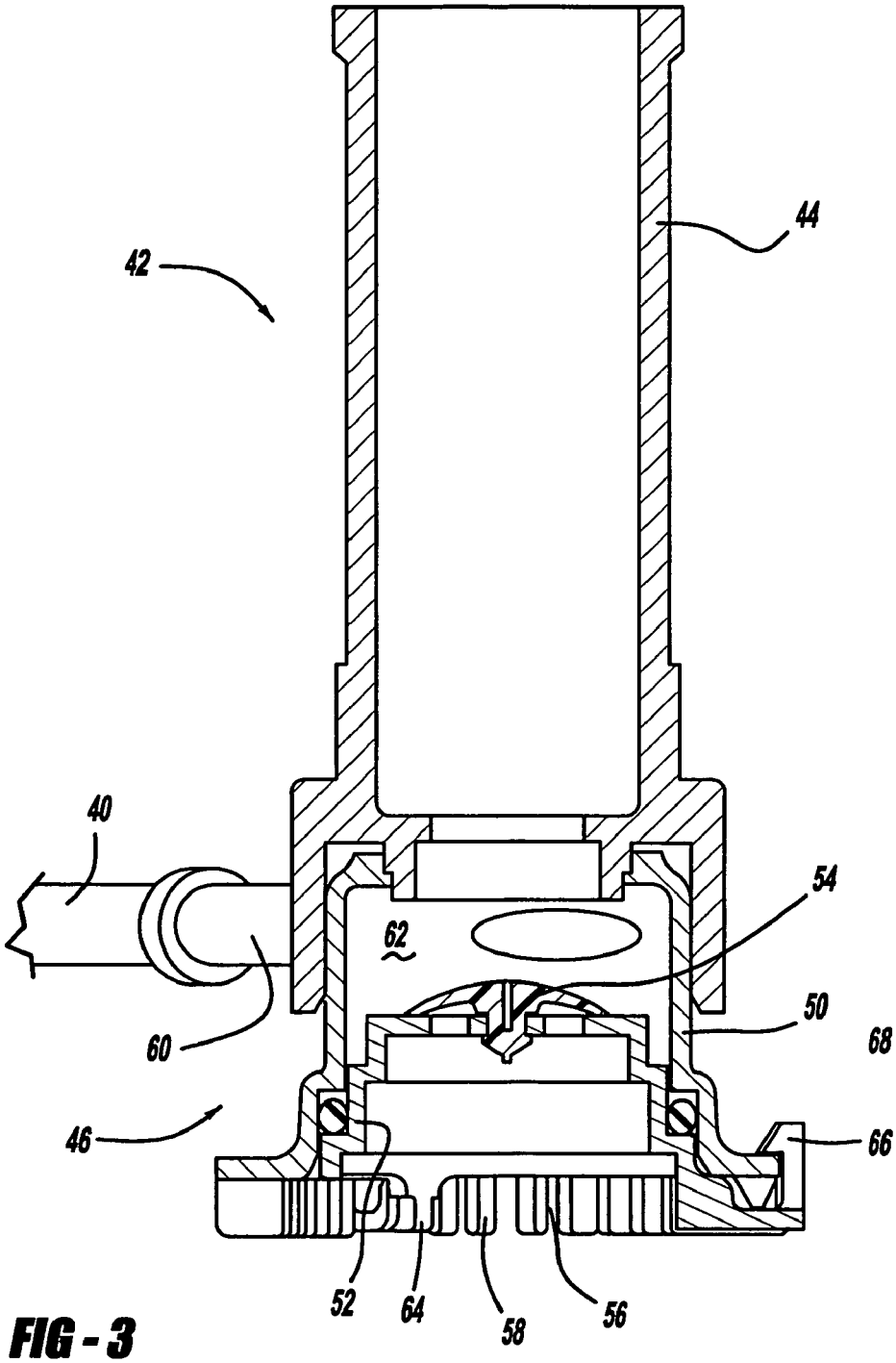
FIG. 3 is an enlarged cross-sectional view of the fuel tank sub side module for the fuel pump module illustrated in FIG. 2.
Figure 4:
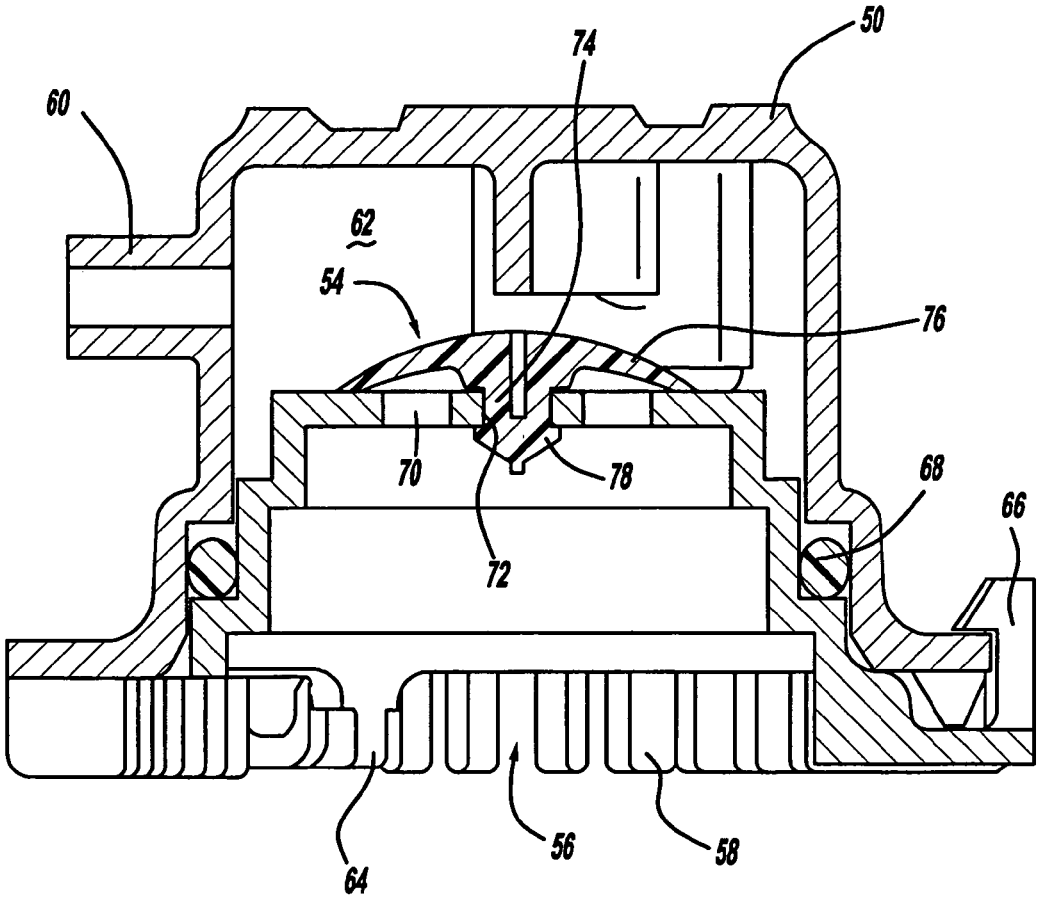
FIG. 4 is an enlarged cross-sectional view of the anti-siphon valve illustrated in FIG. 3.

Referring now to FIGS. 3 and 4, a sub side transfer module 42 which is a part of fuel pump module 22 is illustrated. Sub side transfer module 42 includes an upper housing 44 which is connected to a lower sub side module stay 46. Lower sub side module stay 46 is disposed at the bottom of fuel tank sub side 32 and upper housing 44 extends upward from lower sub side module stay 46 to engage a sub side cap 48 which is secured to fuel tank sub side 32. Upper housing 44 supports various components of fuel pump module 22 such as fuel level sensors as is known well in the art.

Lower sub side module stay 46 comprises an outer housing 50, an umbrella valve plate 52 and an umbrella valve 54. Outer housing 50 rests on the bottom of fuel tank sub side 32 and it includes a fuel inlet 56 formed by a plurality of ribs 58 and fuel outlet 60 which is in communication with transfer line 40. Umbrella valve plate 52 is a cup shaped component which is disposed within outer housing 50 to form a fluid chamber 62. Umbrella valve plate 52 includes a plurality of ribs 64 which prevent sagging of umbrella valve plate 52 and which form a plurality of stays or hooks 66 which secure umbrella valve plate 52 to outer housing 50. A seal 68, such as an O-ring, seals the connection between umbrella valve plate 52 and outer housing 50 to seal chamber 62 whose lower portion acts as a water reservoir to trap condensation or water present in the fuel. Fuel outlet 60 opens into fluid chamber 62 and it can be positioned to overlap the lower portion of fluid chamber 62 which is the water reservoir such that any trapped water in the fluid reservoir will be sucked out of the reservoir when the jet pump operates.

Umbrella valve plate 52 defines a plurality of fuel passages 70 and a central aperture 72. Umbrella valve 54 comprises a central shaft 74 and an umbrella seal 76. Central shaft 74 is disposed within central aperture 72 and which includes an enlarged section 78 which retains umbrella valve 54 within central aperture 72. Umbrella valve 54 is an elastomeric component and umbrella valve 54 is assembled within central aperture 72 by applying pressure to central shaft 74 such that enlarged section 78 is distorted and forced through central aperture 72. Once enlarged section 78 passes through central aperture 72 it springs back to its original shape to retain umbrella valve 54 within central aperture 72. Umbrella seal 76 extends radially out from central shaft 74 to cover and thus close the plurality of fuel passages 70. The outer circumferential edge of umbrella seal 76 sealingly engages umbrella valve plate 52.

When umbrella valve 54 is in its closed position as illustrated in FIG. 4, communication between fuel inlet 56 and fuel outlet 60 is prohibited. Thus, fuel flow from fuel outlet 60, to fuel inlet 56 through chamber 62 is prohibited. Thus, fuel flow through transfer line 40 from fuel tank main side 30 to fuel tank sub side 32 is prohibited. When fuel pressure at fuel inlet 56 exceeds the fuel pressure at fuel outlet 60, umbrella seal 76 of umbrella valve 54 will deflect to allow fuel flow through passages 70 from fuel inlet 56 to fuel outlet 60. Thus, fuel flow through transfer line 40 from fuel tank sub side 32 to fuel tank main side 30 is permitted. Umbrella valve 54 acts as a one-way valve to allow fuel flow from fuel tank sub side 32 to fuel tank main side 30 but to prohibit fuel flow from fuel tank main side 30 to fuel tank sub side 32.

Figure 5:
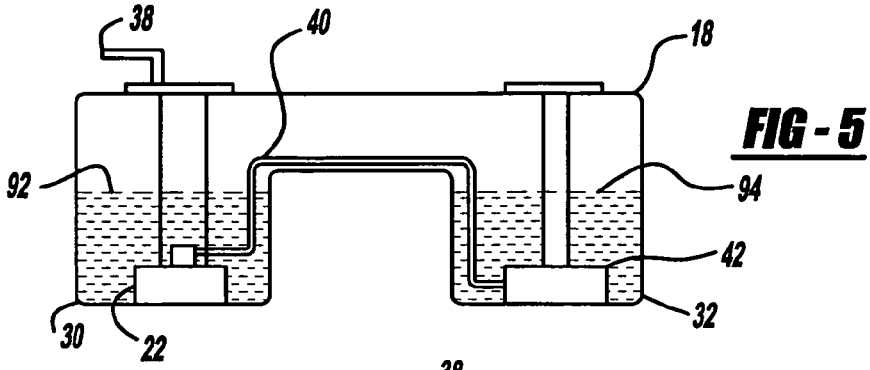
FIG. 5 is a schematic view illustrating one scenario of fuel levels with the fuel tank illustrated in FIGS. 1 and 2.

FIGS. 5-8 depict various fuel transfer scenarios that typically occur in fuel tank 18. FIG. 5 illustrates fuel tank 18 in which fuel levels 92 and 94 are generally equal in fuel tank main side 30 and fuel tank sub side 32. Typically fuel levels 92 and 94 illustrated in FIG. 5 are the fuel levels experienced by vehicle 10 during steady state running of vehicle 10. In fuel tank 18 with fuel levels 92 and 94 illustrated in FIG. 5, the fuel in fuel tank main side 30 is pumped to engine 16 through outlet 38 and fuel line 20. Excess fuel pumped by fuel pump module 22 creates a jet pump, as is known in the art, to draw fuel from fuel tank sub side 32 to fuel tank main side 30 through transfer line 40. Umbrella valve 54 will open to allow fuel flow through transfer line 40 when the fuel pressure at fuel outlet 60 is less than the fuel pressure at fuel inlet 56.

Figure 6:
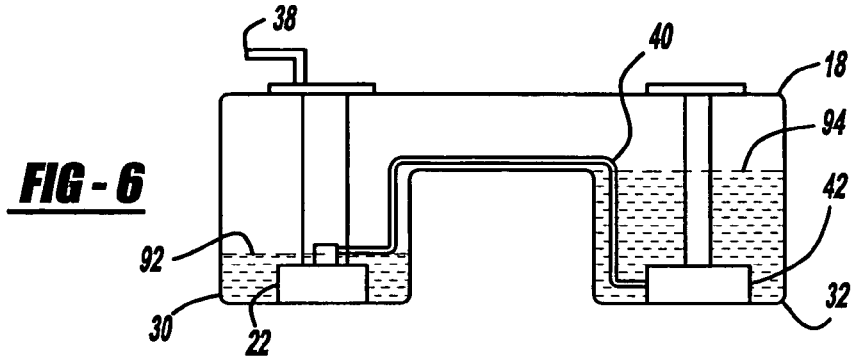
FIG. 6 is a schematic view similar to FIG. 5 but illustrating another scenario of fuel levels with the fuel tank illustrated in FIGS. 1 and 2.
Figure 7:
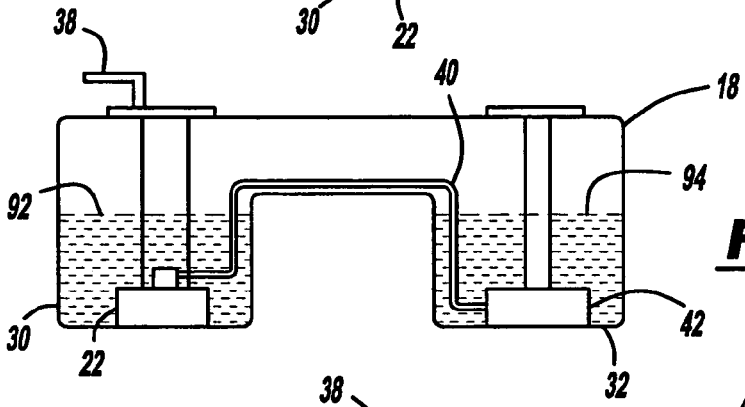
FIG. 7 is a schematic view similar to FIG. 5 but illustrating another scenario of fuel levels with the fuel tank illustrated in FIGS. 1 and 2.

As fuel is pumped from fuel tank main side 30, the jet pump may not sufficiently move fuel from fuel tank sub side 32 to fuel tank main side 30 and the scenario in FIG. 6 can occur. The scenario in FIG. 6 can also occur if vehicle 10 experiences quick, hard cornering. During quick, hard cornering, fuel in fuel tank main side 30 may slosh or transfer to fuel tank sub side 32 through bridge section 34 due to lateral forces experienced during the cornering maneuver. With fuel level 92 in fuel tank main side 30 being low, the jet pump of fuel pump module 22 may not be submerged in fuel and the pumping action of the jet pump will cease. At this point, transferring of fuel between fuel tank sub side 32 and fuel tank main side 30 via siphoning becomes necessary in order to transfer fuel back to fuel tank main side 30. In order for this siphoning action to occur, transfer line 40 must be filled with fuel. Umbrella valve 54 prohibits fuel flow through transfer line 40 from fuel tank main side 30 to fuel tank sub side 32 and thus umbrella valve 54 will ensure that transfer line 40 remains filled with fuel.

With fuel level 94 in fuel tank sub side 32 being higher than fuel level 92 in fuel tank main side 30 as illustrated in FIG. 6 and transfer line 40 being filled with fuel, a siphoning action will occur to move fuel from fuel tank sub side 32 to fuel tank main side 30. The difference in fuel levels 92 and 94 will create a pressure differential across umbrella valve 54 to open umbrella valve 54 and allow the siphoning action to occur. Fuel will continue to be siphoned from fuel tank sub side 32 to fuel tank main side 30 until the jet pump is again primed and will continue with the jet pump action until fuel levels 92 and 94 reach the levels illustrated in FIG. 7.

Figure 8:
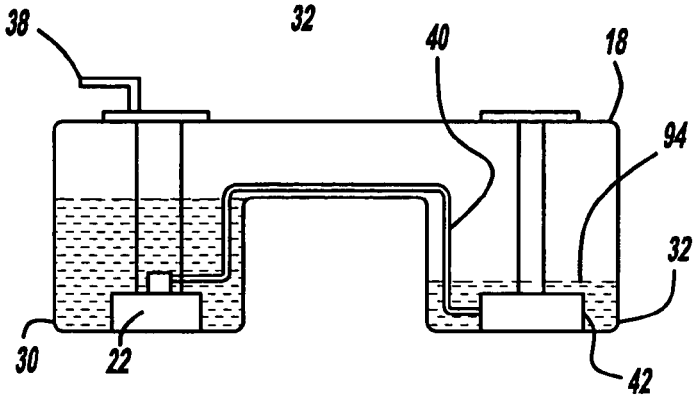
FIG. 8 is a schematic view similar to FIG. 5 but illustrating another scenario of fuel levels with the fuel tank illustrated in FIGS. 1 and 2.

FIG. 8 illustrates the scenario where fuel level 92 in fuel tank main side 30 is higher than fuel level 94 in fuel tank sub side 32. This can occur when the jet pump transfers more fuel than that used by engine 16 or when, due to cornering of vehicle 10, lateral forces slosh or transfer fuel from fuel tank sub side 32 to fuel tank main side 30. The higher level of fuel level 92 in comparison with fuel level 94 will create a higher pressure at fluid outlet 60 than the fuel pressure at fuel inlet 56. Umbrella valve 54 will be urged against umbrella valve plate 52 to close fuel passages 68 and prohibit fuel transfer from fuel tank main side 30 to fuel tank sub side 32 through transfer line 40. Thus, the fuel levels 92 and 94 illustrated in FIG. 8 will remain.

The advantage of fuel levels 92 and 94 illustrated in FIG. 8 are that fuel within fuel tank main side 30 remains ready to be pumped by fuel pump module 22 to engine 16. Fuel from fuel tank main side 30 to fuel tank sub side 32 can only occur through bridge section 34 due to lateral forces being imposed upon vehicle 10 by cornering or by other means. Should this occur and fuel levels 92 and 94 reach the levels depicted in FIG. 6, transfer of fuel from fuel tank sub side 32 to fuel tank main side 30 will again occur as described above.

What is claimed is:

1. A fuel pump system for a vehicle, the fuel pump system comprising:
- a fuel tank having a first and a second section;
- a fuel pump disposed in the first section;
- a jet pump disposed in the first section;
- a transfer line extending between the second section of the fuel tank and an inlet to the jet pump; and
- a check valve disposed in the transfer line in the second section of the fuel tank, the check valve comprising:
  - an outer housing defining an inlet in communication with the second section of the fuel tank and an outlet in communication with the transfer line;
  - a valve plate engaging the outer housing, the valve plate and the housing defining a fluid chamber in communication with the inlet and the outlet; and
  - a water reservoir defined by the fluid chamber, the water reservoir being disposed below a sealing surface of the valve and on an outlet side of the valve.

2. The fuel pump system for a vehicle according to claim 1, wherein the check valve is movable between a closed position where flow from the first section of the fuel tank to the second section of the fuel tank is prohibited and an open position where flow from the second section of the fuel tank to the first section of the fuel tank is permitted.

3. The fuel pump system for a vehicle according to claim 1, wherein the check valve includes an umbrella valve.

4. The fuel pump system for a vehicle according to claim 1, wherein the fuel tank further comprises a bridge section extending between the first and second sections, the transfer line being the only transfer line extending between the first and second sections of the fuel tank.

5. The fuel pump system for a vehicle according to claim 1, wherein the jet pump sucks fuel from the second section of the fuel tank to the first section of the fuel tank through the check valve.

6. The fuel pump system for a vehicle according to claim 1, wherein fuel is retained within the transfer line by the check valve.

7. The fuel pump system for a vehicle according to claim 1, wherein the check valve comprises:
- a valve retained by the valve plate, the valve covering the fluid passage in a closed position to prohibit flow from the inlet to the outlet of the outer housing through the fluid passage, the valve being movable to an open position to permit flow from the inlet to the outlet of the outer housing through the fluid passage.

8. The fuel pump system for a vehicle according to claim 7, wherein the check valve further comprises a seal disposed between the outer housing and the valve plate.

9. The fuel pump system for a vehicle according to claim 7, wherein the valve comprises a central shaft engaging the valve plate and an umbrella seal covering the fluid passage in the closed position.

10. The fuel pump system for a vehicle according to claim 1, wherein the check valve further comprises a valve retained by the valve plate, the valve plate covering a fluid passage in the valve plate in a closed position, the valve being movable to an open position to permit fluid flow from the inlet to the outlet through the fluid passage.

11. The fuel pump system for a vehicle according to claim 10, wherein the outlet overlaps the water reservoir.

12. A fuel pump system for a vehicle, the fuel pump system comprising:
- a fuel tank having a first and a second section;
- a fuel pump disposed in the first section;
- a jet pump disposed in the first section;
- a transfer line extending between the second section of the fuel tank and an inlet to the jet pump; and
- a check valve disposed in the transfer line in the second section of the fuel tank;

wherein the check valve further comprises:
- an outer housing defining an inlet in communication with the second section of the fuel tank and an outlet in communication with the transfer line;
  - a valve plate engaging the outer housing, the valve plate and the housing defining a fluid chamber in communication with the inlet and the outlet; and
  - a water reservoir located below a sealing surface of the valve and defined by the outer housing and the valve plate, wherein the water reservoir is sealed from the second section of the fuel tank.

13. The fuel pump system for a vehicle according to claim 1, wherein the entire water reservoir is also disposed on an outlet side of the valve.

14. A fuel pump system for a vehicle, the fuel pump system comprising:

a fuel tank having a first and a second section;

a fuel pump disposed in the first section;

a jet pump disposed in the first section;

a transfer line extending between the second section of the fuel tank and an inlet to the jet pump; and a check valve disposed in the transfer line in the second section of the fuel tank, the check valve comprising:

an outer housing defining an inlet in communication with the second section of the fuel tank and an outlet in communication with the transfer line;

a valve plate engaging the outer housing, the valve plate and the housing defining a fluid chamber in communication with the inlet and the outlet; and a water reservoir defined by the fluid chamber, the water reservoir being disposed below a sealing surface of the valve, wherein the water reservoir is sealed from the second section of the fuel tank.

15. A fuel pump system for a vehicle, the fuel pump system comprising:

a fuel tank having a first and a second section;

a fuel pump disposed in the first section;

a jet pump disposed in the first section;

a transfer line extending between the second section of the fuel tank and an inlet to the jet pump; and a check valve disposed in the transfer line in the second section of the fuel tank;

wherein the check valve further comprises:

an outer housing defining an inlet in communication with the second section of the fuel tank and an outlet in communication with the transfer line;

a valve plate engaging the outer housing, the valve plate and the housing defining a fluid chamber in communication with the inlet and the outlet; and a water reservoir located below a sealing surface of the valve and defined by the outer housing and the valve plate wherein the water reservoir is also disposed on an outlet side of the valve.

16. The fuel pump system for a vehicle according to claim 15, wherein the entire water reservoir is also disposed on an outlet side of the valve.

* * * * *